US009381618B2

(12) United States Patent
Kaul et al.

(10) Patent No.: US 9,381,618 B2
(45) Date of Patent: Jul. 5, 2016

(54) GRINDING AND POLISHING TOOL

(71) Applicants: SAINT-GOBAIN ABRASIVES, INC., Worcester, MA (US); SAINT-GOBAIN ABRASIFS, Conflans-Sainte-Honorine (FR)

(72) Inventors: Rajesh Kaul, Shrewsbury, MA (US); John Tunstall, Buffalo Grove, IL (US); Shivshankar Sivasubramanian, Lowell, MA (US); Srinivasan Ramanath, Holden, MA (US); Rachana Upadhyay, Shrewsbury, MA (US); Arup K Khaund, Northborough, MA (US); Yinggang Tian, Shrewsbury, MA (US); John Pearlman, Berlin, MA (US); Michael D. Cheng, St. Charles, IL (US); Cecile O. Mejean, Marlborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 14/258,277

(22) Filed: Apr. 22, 2014

(65) Prior Publication Data

US 2014/0323020 A1 Oct. 30, 2014

Related U.S. Application Data

(60) Provisional application No. 61/815,889, filed on Apr. 25, 2013, provisional application No. 61/815,942, filed on Apr. 25, 2013.

(51) Int. Cl.

| | |
|---|---|
| ***B24D 5/10*** | (2006.01) |
| ***B24D 5/06*** | (2006.01) |
| ***B24B 9/08*** | (2006.01) |

(52) U.S. Cl.
CPC . *B24D 5/066* (2013.01); *B24B 9/08* (2013.01); *B24D 5/10* (2013.01)

(58) Field of Classification Search
CPC ..... B24B 9/08; B24D 5/10; B24D 5/06; B24D 5/066
USPC ..... 451/547, 44, 43, 541, 58, 57, 508, 488
See application file for complete search history.

(56) References Cited

U.S. PATENT DOCUMENTS 3,190,045 A 6/1965 Zuzelo
5,865,571 A * 2/1999 Tankala et al. ..... 408/1 R (Continued)

FOREIGN PATENT DOCUMENTS

EP 0268672 B1 9/1990
EP 0531299 B1 3/1993

(Continued)

OTHER PUBLICATIONS

International Search Report for PCT/US2014/034892 dated Aug. 29, 2014, 4 pgs.
Technical Search, 4 pgs, 2013.
"Abrasive Article", 1 pg, 2013.

*Primary Examiner* — Robert Rose
(74) *Attorney, Agent, or Firm* — Abel Law Group, LLP; Joseph P. Sullivan

(57) ABSTRACT

A grinding tool includes a shank having an axis, and at least two abrasive portions mounted directly to and in contact with the shank without a hub therebetween. Each of the abrasive portions has a substantially identical profile formed therein.

20 Claims, 7 Drawing Sheets

(56) References Cited

U.S. PATENT DOCUMENTS

| | | | | |
|---|---|---|---|---|
| 5,882,247 | A * | 3/1999 | Longuet | B24B 9/14 451/236 |
| 5,951,381 | A | 9/1999 | Videcoq et al. | |
| 6,287,176 | B1 * | 9/2001 | Voigt | 451/44 |
| 6,551,180 | B2 | 4/2003 | Braasch | |
| 6,966,824 | B2 * | 11/2005 | Kotting | B24B 45/006 451/177 |
| 2007/0157993 | A1 | 7/2007 | Yoon | |
| 2011/0037945 | A1 * | 2/2011 | Wiand | 351/174 |
| 2013/0005222 | A1 | 1/2013 | Brown et al. | |

FOREIGN PATENT DOCUMENTS

| | | | |
|---|---|---|---|
| EP | 0846041 | B1 | 6/1998 |
| EP | 1174219 | B1 | 1/2002 |
| EP | 1418020 | A1 | 5/2004 |
| EP | 2184134 | A1 | 5/2010 |
| EP | 2483036 | A1 | 8/2012 |
| KR | 10-2010-0106056 | A | 10/2010 |
| WO | 96-11771 | A1 | 4/1996 |
| WO | 2011041498 | A1 | 4/2011 |

* cited by examiner

GRINDING AND POLISHING TOOL

CROSS-REFERENCE TO RELATED APPLICATION(S)

This application claims priority to and the benefit of U.S. Prov. Pat. App. No. 61/815,889, filed Apr. 25, 2013, U.S. Prov. Pat. App. No. 61/815,942, filed Apr. 25, 2013, which are incorporated herein by reference in their entirety.

BACKGROUND OF THE INVENTION

1. Field of the Disclosure

The present invention relates in general to abrasive tools and, in particular, to a profiled grinding and polishing tool.

2. Description of the Related Art

The edges of thin glass substrates are usually ground and polished to achieve a desired surface finish. The conventional technique used to grind and polish the edges sequentially uses several abrasive tools, each of which provides a progressively finer surface along the edges of the thin glass. For example, a first coarse grinding tool is installed and used to achieve a coarse surface finish. The first course grinding tool is then removed and replaced by a fine grinding tool to improve the thin glass edge to a fine grind. The fine grinding tool is then removed and by a polishing tool to achieve the desired surface finish. Although these tools and this process are workable, improvements in grinding and polishing the edges of thin glass continue to be of interest.

SUMMARY

Embodiments of a grinding and polishing tool are disclosed. For example, an abrasive article may comprise a shank having an axis, and at least two abrasive portions mounted directly to and in contact with the shank in an axial array. Each of the abrasive portions may have a substantially identical profile formed therein.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
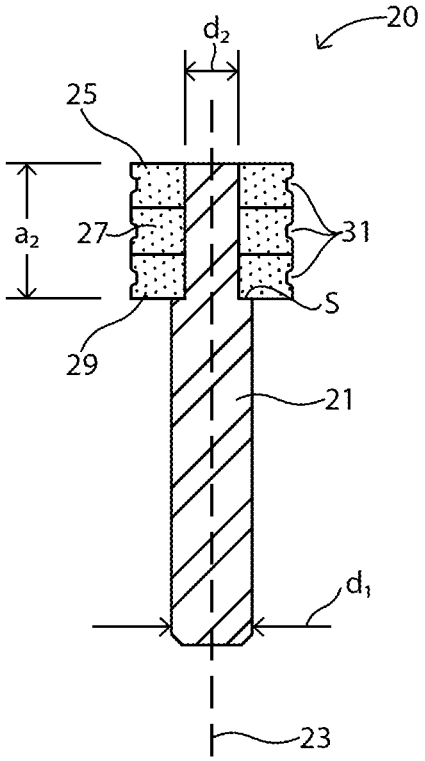
FIG. 1 is sectional side view of an embodiment of a tool.

Embodiments of a grinding and polishing tool are disclosed. For example, FIG. 1 depicts an abrasive article 20 comprising a shank 21 having a rotational axis 23 and at least two abrasive portions 25, 27 (a third abrasive portion 29 is shown). Each abrasive portion 25, 27, 29 may be configured to grind or polish glass, such as the perimeter edge of glass, depending on the application. For example, the glass to be ground or polished may comprise a chemically-strengthened, ion exchange glass.

Each abrasive portion 25, 27, 29 may be mounted to the shank 21. The abrasive portions 25, 27, 29 may be mounted on the shank 21 and each other by a variety of methods, such as adhesive bonding, with a fastener, or a combination thereof. In some versions, the abrasive portions 25, 27, 29 are not electroplated on the shank 21. The abrasive portions 25, 27, 29 may be configured on the shank 21 in an axial array as shown.

Each abrasive portion 25, 27, 29 may comprise an identical shape or they may differ in shape. In FIG. 1, the abrasive portions 25, 27, 29 comprise flat circular disks (e.g., a wheel) with a central opening or axial bore, a diameter and an axial thickness. In some versions, the diameter of each abrasive portion 25, 27, 29 may be not greater than about 25 mm, such as not greater than about 20 mm, not greater than about 15 mm, not greater than about 12 mm, or even not greater than about 10 mm.

Again referring to FIG. 1, the shank 21 may comprise a single spindle having a proximal portion with a first diameter d1, a distal portion with a second diameter d2 that is smaller than the first diameter d1, and a shoulder s therebetween. Each of the abrasive portions 25, 27, 29 may have a diameter in excess of the diameters d1 and d2 of the shank 21. The diameter d2 of the shank 21 can be at least about 1 mm, such as at least about 2 mm, at least about 3 mm, at least about 4 mm, or even at least about 5 mm. The diameter d2 of the shank 21 can be not greater than about 10 mm, such as not greater than about 8 mm, or even not greater than about 6 mm.

In some embodiments, the diameters d1 and d2 may be expressed as a ratio d2/d1. In some versions, the ratio d2/d1 may be greater than or equal to 0.5. The distal portion of the shank 21 having diameter d2 has an axial length a2. The axial length a2 may be substantially equal in length to a total axial length of the abrasive portions 25, 27, 29.

The abrasive portions 25, 27, 29 may be directly mounted to and in contact with the distal portion of shank 21. One of the abrasive portions 29 may be mounted directly to and in axial abutment with the shoulder s. Other ones of the abrasive portions 25, 27 may axially abut the abrasive portion 29 (or other abrasive portions) and may be axially spaced apart from the shoulder S as shown.

Embodiments of the abrasive portions 25, 27, 29 may comprise a metal bond. The metal bond may comprise copper and tin. For example, some versions of the metal bond may comprise about 79% copper, about 20% tin and about 1% phos-copper powder. Phos-copper powder may comprise a mix of phosphorus and copper with the phosphorus not exceeding about 6% of the total volume mix.

Some embodiments of the abrasive portions 25, 27, 29 may not comprise a resin bond. The abrasive portions 25, 27, 29 may comprise abrasive particles such as diamond grit or cubic boron nitride.

Each of the abrasive portions 25, 27, 29 may comprise abrasive particles that differ from each other in a chosen parameter, such as size, type or grade. For example, a first one of the abrasive portions 25 may comprise a grit size of not greater than about 700 grit, such as not greater than about 600 grit, not greater than about 500 grit, or even not greater than about 400 grit. In other embodiments, the first one of the abrasive portions 25 may comprise a grit size of at least about 100 grit, such as at least about 200 grit, or even at least about 300 grit. The grit size of the first one of the abrasive portions 25 may comprise a value between any of these minimum and maximum values.

Embodiments of a second one of the abrasive portions 27 may comprise a grit size of not greater than about 1100 grit, such as not greater than about 1000 grit, not greater than about 900 grit, or even not greater than about 800 grit. In other embodiments, the first one of the abrasive portions 25 may comprise a grit size of at least about 500 grit, such as at least about 600 grit, or even at least about 700 grit. The grit size of the second one of the abrasive portions 27 may comprise a value between any of these minimum and maximum values.

Some embodiments of a third one of the abrasive portions 29 may comprise a grit size of not greater than about 2000 grit, such as not greater than about 1500 grit, not greater than about 1400 grit, or even not greater than about 1200 grit. In other embodiments, the third one of the abrasive portions 29 may comprise a grit size of at least about 900 grit, such as at least about 1000 grit, or even at least about 1100 grit. The grit size of the third one of the abrasive portions 29 may comprise a value between any of these minimum and maximum values.

Figure 2:
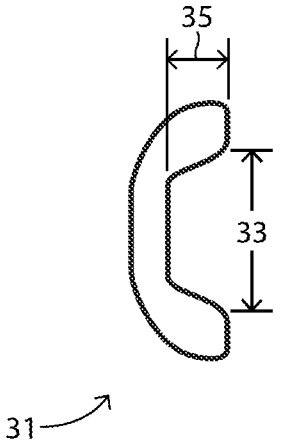
FIG. 2 is an enlarged sectional side view of an embodiment of a profile formed in the tool of FIG. 1.

In some versions, one or more of the abrasive portions 25, 27, 29 may comprise a profile 31 (FIGS. 1 and 2) formed therein. The profiles 31 may be formed in exterior surfaces or perimeters of the abrasive portions 25, 27, 29 such that they are completely circumscribed by the profiles 31. Embodiments of the profiles 31 may be formed by electrical discharge machining (EDM) in some cases. Versions of the profiles can be re-profiled without damaging the abrasive article 20. For example, the profiles may be re-profiled by EDM so that the abrasive article 20 can be reused.

Embodiments of the profiles 31 may be identical or different. For example, the profiles differ from each other by less than about 1%, less than about 0.5%, less than about 0.25%. Some versions of each profile may comprise a flat profile, a flat and arris profile (shown in FIG. 2), or a bullnose profile. The profile 31 may have an axial dimension 33 of not greater than about 1.5 mm, such as not greater than about 1.3 mm, not greater than about 1 mm, not greater than about 0.7 mm, not greater than about 0.5 mm, or even not greater than about 0.3 mm. In other versions, the axial dimension 33 can be at least about 0.1 mm, such as at least about 0.2 mm, or even at least about 0.3 mm. The axial dimension may comprise a value between any of these minimum and maximum values.

Versions of the profile 31 can have has a radial grind depth 35 of at least about 0.1 mm, such as at least about 0.2 mm, at least about 0.3 mm, or even at least about 0.4 mm. Other embodiments of the radial grind depth 35 can be not greater than about 0.9 mm, such as not greater than about 0.7 mm, or even not greater than about 0.5 mm. The radial grind depth 35 may comprise a value between any of these minimum and maximum values.

Figure 3:
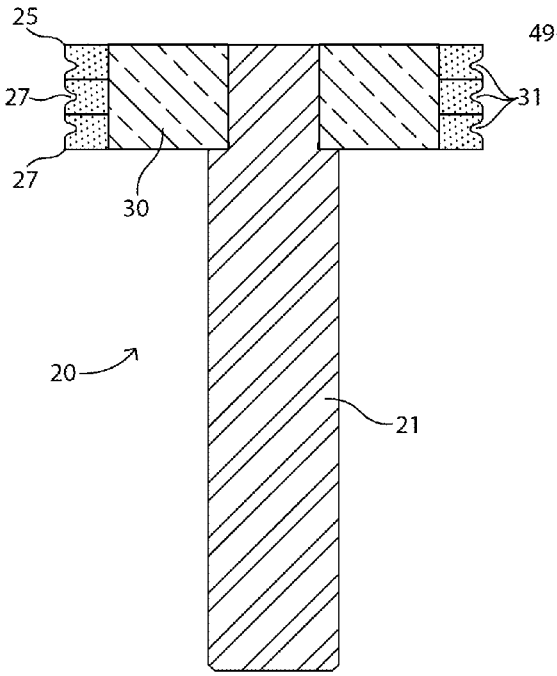
FIGS. 3-5 are sectional side views of other embodiments of a tool.
Figure 10:
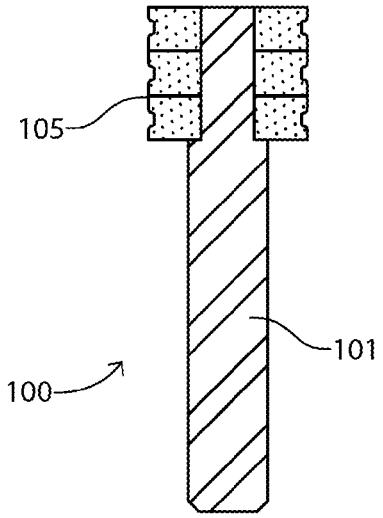
FIGS. 10 and 11 are sectional side views of other embodiments of a tool.

As shown in FIG. 3, embodiments of the abrasive article 20 may have at least one abrasive portion 25, 27, 29 that comprises cerium oxide. For example, a finest one of the abrasive portions 29 may comprise cerium oxide. FIG. 3 also illustrates an embodiment where the abrasive portions 25, 27, 29 are mounted to a hub 30, rather than directly to the shank 21. The hub 30 is mounted directly to the shank 21, such that the abrasive portions 25, 27, 29 are radially spaced apart from shank 21 and axially abut each other. FIG. 10 depicts an alternate embodiment of an abrasive article 100 having at least one abrasive portion 105 comprising cerium oxide and mounted directly to the shaft 101 without a hub therebetween.

Figure 4:
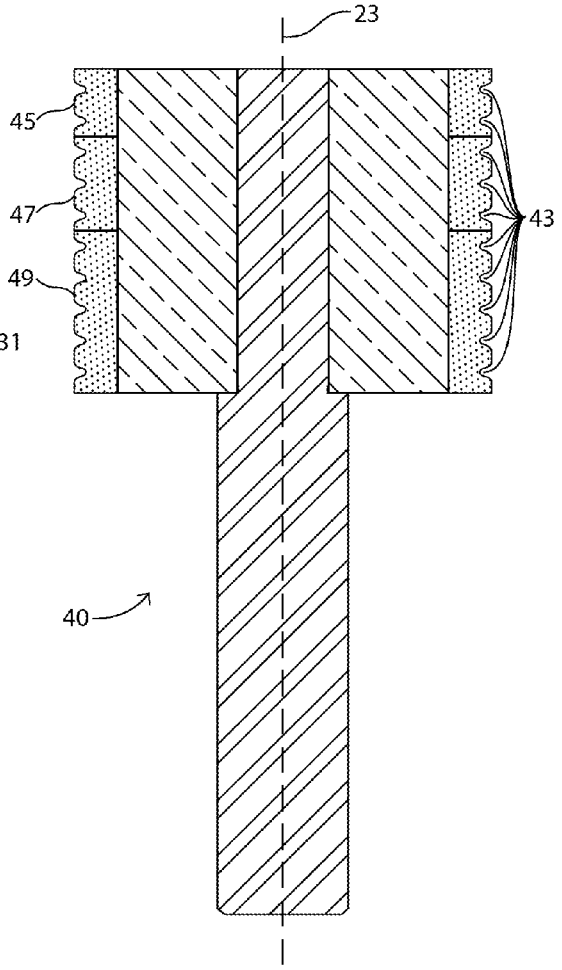

FIG. 4 depicts an embodiment of an abrasive article 40 having abrasive portions 45, 47, 49, each with more than one profile 43 (i.e., at least two profiles 43) formed therein. The profiles 43 within each of the abrasive portions 45, 47, 49 can be substantially identical or different. In some versions, a coarsest one of the abrasive portions 45 may comprise the fewest number of profiles 43, and a finest one of the abrasive portions 49 may comprise the highest number of profiles 43. An intermediate abrasive portion 47 may be is finer than the coarsest abrasive portion 45, and coarser than the finest abrasive portion 49. The intermediate abrasive portion 47 may comprise a number of profiles 43 that is greater than that of the coarsest abrasive portion 45, and less than that of the finest abrasive portion 49. For example, the abrasive portions 45, 47, 49 may comprise 2, 3 and 5 profiles, respectively, in one embodiment.

Figure 11:
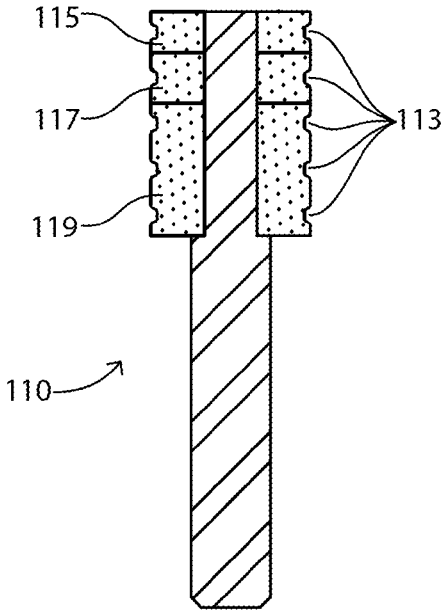

FIG. 11 depicts an alternate embodiment of an abrasive article 110 having abrasive portions 115, 117, 119. At least one of the abrasive portions 115, 117, 119 has more than one profile 113. In the version shown, abrasive portion 119 has three profiles 113, while abrasive portions 115, 117 each have one profile 113.

In some embodiments, the profiles 43 may be at a substantially same radial distance relative to the axis 23, but at different axial locations. For example, the profiles 43 may be axially spaced apart from each other in substantially identical increments, or at different increments.

Figure 5:
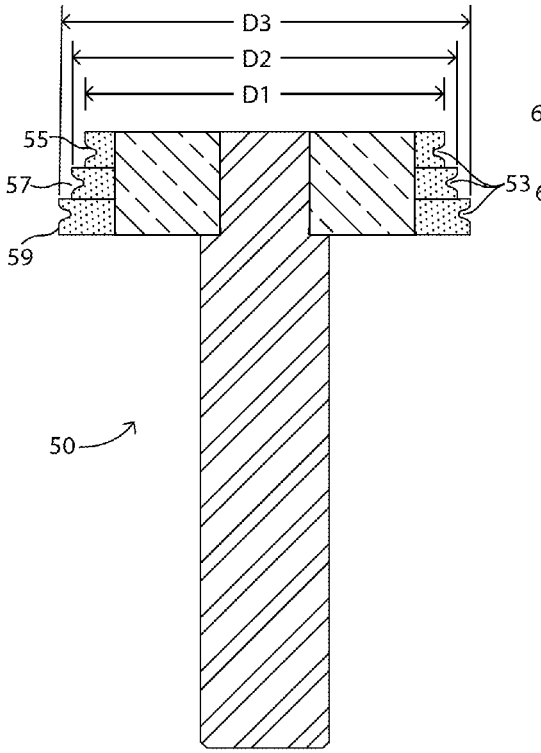

Although some embodiments of the abrasive portions have an outer surface that is substantially cylindrical, they are not so limited. For example, the abrasive portions can have an outer surface that is non-cylindrical (FIG. 5), such as a conical shape or steps, such that the respective outer surfaces thereof have different maximum radial dimensions D1, D2, D3. In some versions, each abrasive portion 55, 57, 59 may comprise a plurality of steps, each having a profile 53. Each step can have a different maximum radial dimension within each abrasive portion 55, 57, 59.

Figure 6A:
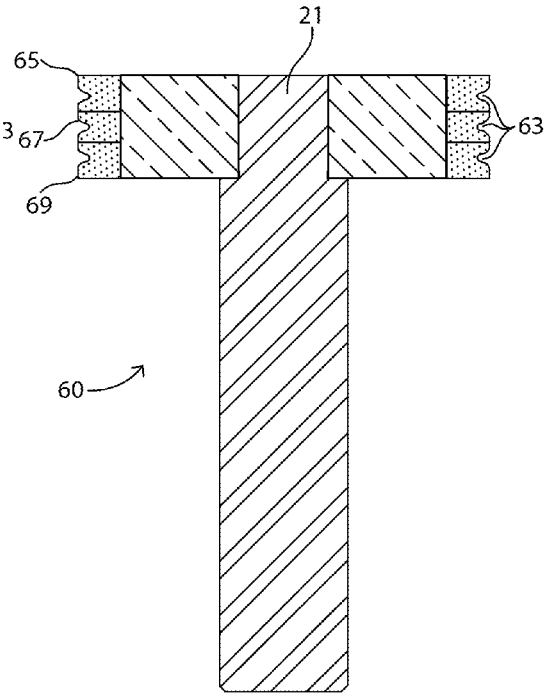
FIGS. 6A and 6B are sectional side and half top views, respectively, of another embodiment of a tool.
Figure 6B:
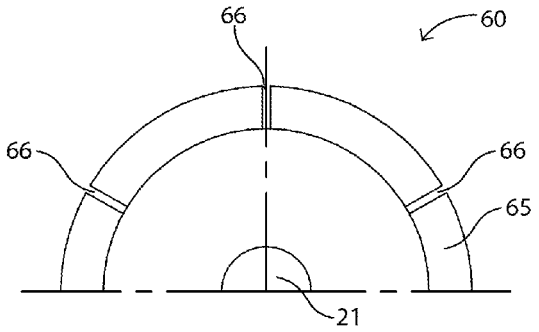

FIGS. 6A and 6B illustrate an embodiment of an abrasive article 60 having abrasive portions 65, 67, 69 with have an outer surface. At least one recess 66 extends axially along at least a portion of the outer surface of at least one of the abrasive portions 65, 67, 69. Embodiments of the recess 66 may comprise a slot, notch or groove, and may extend along an entire axial length of the abrasive portions 65, 67, 69. Versions of the recess 66 may comprise a plurality of recesses 66, which may be symmetrically spaced apart about the outer surface. For example, the abrasive article 60 may comprise six of the recesses 66, which may be angularly offset (relative to the axis) from adjacent ones thereof by 60 degrees.

Figure 12A:
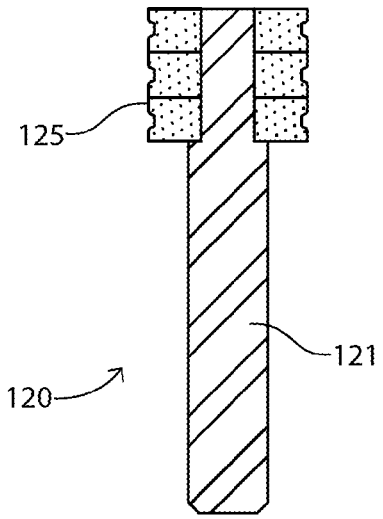
FIGS. 12A and 12B are sectional side and half top views, respectively, of another embodiment of a tool.
Figure 12B:
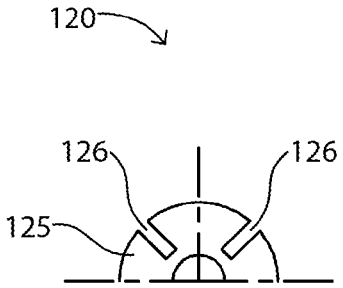

FIGS. 12A and 12B depict an alternate embodiment of an abrasive article 120 having at least one abrasive portion 125 with an outer surface. Abrasive portion 125 is mounted directly to shaft 121 with no hub therebetween. At least one recess 126 extends axially along at least a portion of the outer surface of at least one of the abrasive portion 125. Embodiments of the recess 126 may comprise a slot, notch or groove, and may extend along an entire axial length of the abrasive portions 125. Versions of the recess 126 may comprise a plurality of recesses 126, which may be symmetrically spaced apart about the outer surface. For example, the abrasive article 120 may comprise four of the recesses 126, which may be angularly offset (relative to the axis) from adjacent ones thereof by 90 degrees.

Figure 7:
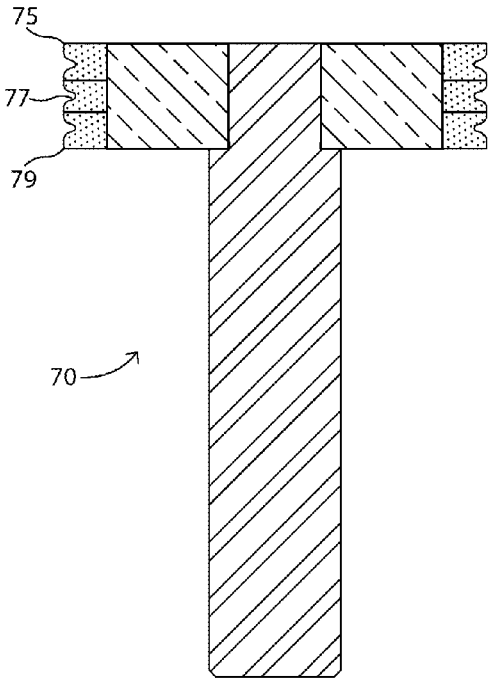
FIGS. 7 and 8 are sectional side views of additional embodiments of a tool.
Figure 13:
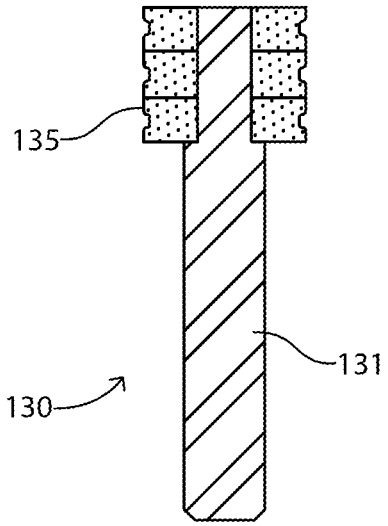
FIGS. 13 and 14 are sectional side views of additional embodiments of a tool.

Some embodiments of the abrasive article 70 (FIG. 7) may have one or more abrasive portions 75, 77, 79 that comprise a porosity. The porosity may be in a range of, for example, about 1 vol % to about 5 vol %. In some versions, the porosity may be formed by hollow glass and/or ceramic beads. FIG. 13 depicts an alternate embodiment of an abrasive article 130 having at least one abrasive portion 135 mounted directly to shaft 131 with no hub therebetween. Abrasive portion 135 likewise has porosity that may be formed by glass and/or ceramic beads during fabrication.

Figure 8:
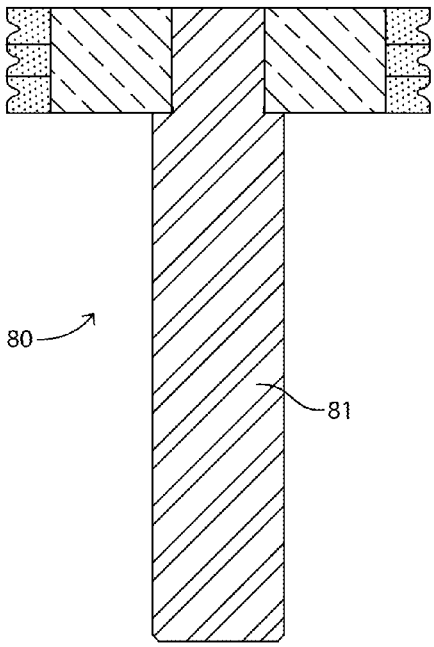
Figure 14:
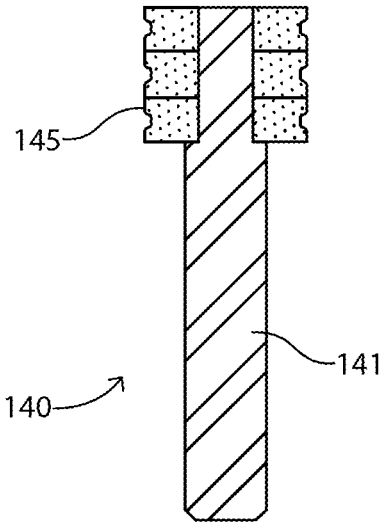

In still another embodiment of the abrasive article 80 (FIG. 8), the shank 81 may comprise a metallic material or a non-metallic material, such as carbon fiber. Non-metallic materials such as carbon fiber offer improved vibration and noise dampening. FIG. 14 depicts an alternate embodiment of an abrasive article 140 having at least one abrasive portion 145 mounted directly to shaft 141 with no hub therebetween. Shaft 141 likewise may be formed from a non-metallic material such as carbon fiber.

Figure 9A:
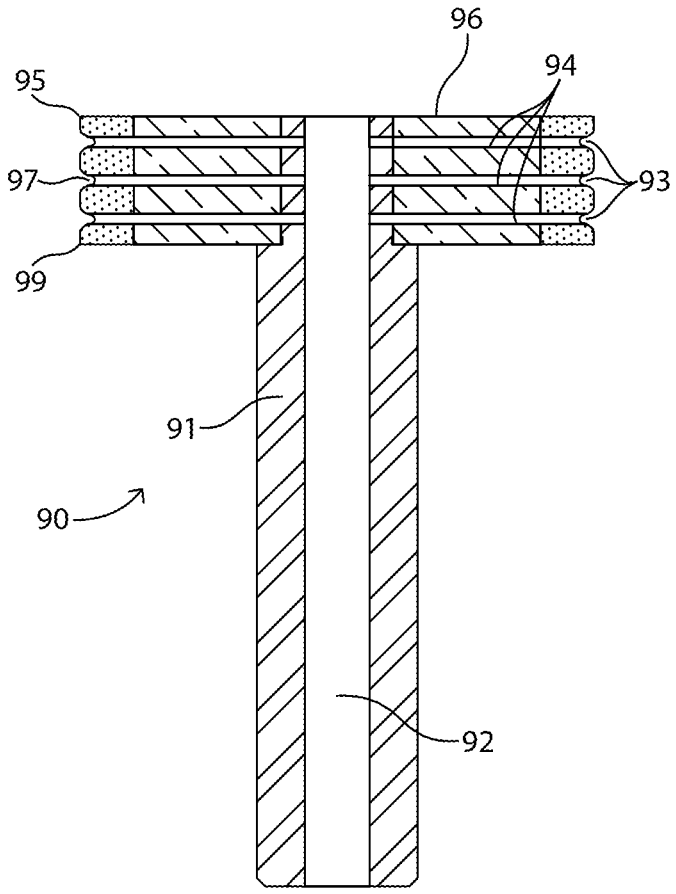
FIGS. 9A and 9B are sectional side and half top views, respectively, of another embodiment of a tool.
Figure 9B:
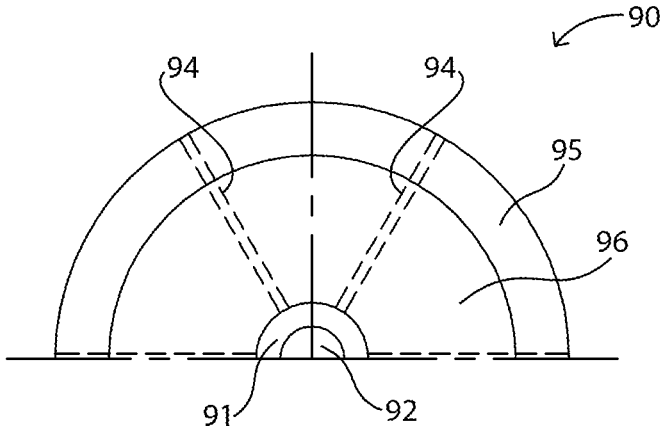

Embodiments of an abrasive article 90 (FIGS. 9A and 9B) may comprise one or more fluid passages 92 for delivering a liquid coolant and/or lubricant. For example, the shank 91 and/or at least one of the abrasive portions 95, 97, 99 may comprise a fluid passage 92, 94, respectively. The fluid passages 92, 94 may be interconnected and configured to permit a liquid to flow therethrough. The fluid passages 94 may extend not only through the abrasive portions 95, 97, 99, but also through a portion of the shank 91 and/or a hub 96 mounted between shank 91 and them. One or more of the abrasive portions 95, 97, 99 may have a profile 93 formed therein. One or more fluid passages 94 94 in the abrasive portions 95, 97, 99 may intersect the profiles 93, respectively. A closure, such as a plug, may be used on one end of fluid passage 92.

In still other embodiments, an abrasive article may comprise one or more of any of the features described herein.

In operation, the abrasive articles described may be used in a method of grinding and polishing a workpiece having an edge profile. Embodiments of the method may comprise providing a workpiece having a perimeter/peripheral edge; chucking the workpiece to resist movement of the workpiece; grinding the perimeter edge of the workpiece with a tool to form a first surface finish on the perimeter edge; and then polishing the perimeter edge of the workpiece with the same tool to form a second surface finish on the perimeter edge, wherein the second surface finish is finer than the first surface finish.

Embodiments of grinding and polishing each may comprise circumscribing an entirety of the perimeter edge of the workpiece. In some versions, the workpiece may have a thickness of not greater than about 1.3 mm. Moreover, grinding and polishing each may comprise rotating the tool at a speed of about 5,000 rpm to about 50,000 rpm. In addition, chucking may comprise vacuum chucking opposing surfaces of the workpiece.

Embodiments of a method of forming a tool may comprise forming at least two abrasive portions in separate molds, each of the abrasive portions comprising a different size; removing the at least two abrasive portions from the separate molds; pressing the at least two abrasive portions together to form an abrasive article; and then mounting the abrasive article on a shank such that the at least two abrasive portions form an axial array on the shank. In some embodiments the method may further comprise forming a profile in each abrasive portion, such as with EDM. Mounting may comprise bonding the abrasive article to the shank with an adhesive, and/or securing the abrasive article to the shank with a screw threaded axially into the shank adjacent a distal end of the abrasive article.

Embodiments of forming may comprise forming each abrasive portion as a solid object and, prior to mounting, further comprise forming a bore in the abrasive article, such that mounting comprises extending the shank through the bore. Forming may comprise separately cold pressing each of the abrasive portions. Pressing may comprise hot pressing and sintering the abrasive portions together to form the abrasive article.

Additional embodiments may include one or more of the following items.

Item 1. An abrasive article, comprising:

a shank having an axis; and at least two abrasive portions mounted directly to and in contact with the shank in an axial array, each of the abrasive portions having a substantially identical profile formed therein.

Item 2. The abrasive article of any of these items, wherein a first one of the abrasive portions comprises a grit size of not greater than about 700 grit, not greater than about 600 grit, not greater than about 500 grit, not greater than about 400 grit.

Item 3. The abrasive article of any of these items, wherein a second one of the abrasive portions comprises a grit size of not greater than about 1100 grit, not greater than about 1000 grit, not greater than about 900 grit, not greater than about 800 grit, and at least about 500 grit, at least about 600 grit, at least about 700 grit.

Item 4. The abrasive article of any of these items, wherein a third one of the abrasive portions comprises a grit size of not greater than about 2000 grit, not greater than about 1500 grit, not greater than about 1400 grit, not greater than about 1200 grit, and at least about 900 grit, at least about 1000 grit, at least about 1100 grit.

Item 5. The abrasive article of any of these items, wherein each of the abrasive portions comprises a profile formed therein.

Item 6. The abrasive article of any of these items, wherein the profile is formed in an exterior surface or perimeter of each abrasive portion, and circumscribes each abrasive portion.

Item 7. The abrasive article of any of these items, wherein the profile is formed by electrical discharge machining (EDM).

Item 8. The abrasive article of any of these items, wherein the profile can be re-profiled without damaging the abrasive article.

Item 9. The abrasive article of any of these items, wherein the profile is re-profiled by electrical discharge machining (EDM).

Item 10. The abrasive article of any of these items, wherein the profile has an axial dimension of not greater than about 1.5 mm, not greater than about 1.3 mm, not greater than about 1 mm, not greater than about 0.7 mm, not greater than about 0.5 mm, not greater than about 0.3 mm, and the axial dimension is at least about 0.1 mm, at least about 0.2 mm, or at least about 0.3 mm.

Item 11. The abrasive article of any of these items, wherein the profile comprises a flat profile, a flat and arris profile, or a bullnose profile.

Item 12. The abrasive article of any of these items, wherein the profile has a radial grind depth of at least about 0.1 mm, at least about 0.2 mm, at least about 0.3 mm, or at least about 0.4 mm, and not greater than about 0.9 mm, not greater than about 0.7 mm, or not greater than about 0.5 mm.

Item 13. The abrasive article of any of these items, wherein the profile in each abrasive portion is substantially identical.

Item 14. The abrasive article of any of these items, wherein the profiles are at a substantially same radial distance relative to the axis, but at different axial locations.

Item 15. The abrasive article of any of these items, wherein the profiles differ from each other by less than about 1%, less than about 0.5%, less than about 0.25%.

Item 16. The abrasive article of any of these items, wherein the profiles are axially spaced apart from each other in substantially identical increments.

Item 17. The abrasive article of any of these items, wherein the abrasive portions do not comprise a resin bond.

Item 18. The abrasive article of any of these items, wherein the abrasive portions comprise a metal bond.

Item 19. The abrasive article of any of these items, wherein the metal bond comprises copper and tin.

Item 20. The abrasive article of any of these items, wherein the abrasive portions comprise at least three abrasive portions.

Item 21. The abrasive article of any of these items, wherein each abrasive portion is configured to grind or polish glass.

Item 22. The abrasive article of any of these items, wherein the glass comprises a chemically-strengthened, ion exchange glass.

Item 23. The abrasive article of any of these items, wherein the abrasive portions are not electroplated on the shank.

Item 24. The abrasive article of any of these items, wherein the abrasive portions are mounted on the shank with an adhesive bond.

Item 25. The abrasive article of any of these items, wherein the abrasive portions comprise diamond grit.

Item 26. The abrasive article of any of these items, wherein each abrasive portion comprises a wheel having an axial bore, a diameter and an axial thickness.

Item 27. The abrasive article of any of these items, wherein the diameter of each wheel is not greater than about 25 mm, not greater than about 20 mm, not greater than about 15 mm, not greater than about 12 mm, or not greater than about 10 mm.

Item 28. The abrasive article of any of these items, wherein the shank is a single spindle having a proximal portion with a first diameter, a distal portion with a second diameter that is smaller than the first diameter, and a shoulder therebetween.

Item 29. The abrasive article of any of these items, wherein the abrasive portions are mounted on the distal portion, one of the abrasive portions abuts the shoulder, and another one of the abrasive portions abuts said one of the abrasive portions and is axially spaced apart from the shoulder.

Item 30. The abrasive article of any of these items, wherein each of the abrasive portions has a diameter in excess of a diameter of the shank.

Item 31. The abrasive article of any of these items, wherein the diameter of the shank is at least about 1 mm, at least about 2 mm, at least about 3 mm, at least about 4 mm, at least about 5 mm, and not greater than about 10 mm, not greater than about 8 mm, not greater than about 6 mm.

Item 32. The abrasive article of any of these items, wherein the abrasive portions are mounted directly to and in axial abutment with each other.

Item 33. The abrasive article of any of these items, wherein the at least two abrasive portions have an outer surface that is substantially cylindrical.

Item 34. An abrasive article, comprising:

a shank having an axis;

at least two abrasive portions coupled to the shank in an axial array, each of the abrasive portions having a substantially identical profile formed therein; and at least one of the abrasive portions has at least two of the substantially identical profiles formed therein.

Item 35. An abrasive article, comprising:

a shank having an axis;

at least two abrasive portions coupled to the shank in an axial array, each of the abrasive portions having a substantially identical profile formed therein; and at least one of the abrasive portions comprises cerium oxide.

Item 36. An abrasive article, comprising:

a shank having an axis;

at least two abrasive portions coupled to the shank in an axial array, each of the abrasive portions having a substantially identical profile formed therein; and the abrasive portions have an outer surface that is non-cylindrical.

Item 37. An abrasive article, comprising:

a shank having an axis;

at least two abrasive portions coupled to the shank in an axial array, each of the abrasive portions having a substantially identical profile formed therein; and at least one of the abrasive portions has an outer surface, and further comprising a recess extending axially along at least a portion of the outer surface.

Item 38. An abrasive article, comprising:

a shank having an axis;

at least two abrasive portions coupled to the shank in an axial array, each of the abrasive portions having a substantially identical profile formed therein; and at least one of the abrasive portions comprises a porosity in a range of about 1 vol % to about 5 vol %.

Item 39. An abrasive article, comprising:

a shank comprising carbon fiber and having an axis; and at least two abrasive portions coupled to the shank in an axial array, each of the abrasive portions having a substantially identical profile formed therein.

Item 40. An abrasive article, comprising:

a shank having an axis;

at least two abrasive portions coupled to the shank in an axial array, each of the abrasive portions having a substantially identical profile formed therein; and the shank and each of the abrasive portions comprises a fluid passage, and the fluid passages are interconnected and configured to permit fluid flow therethrough.

Item 41. The abrasive article of any of these items, wherein a coarsest one of the abrasive portions comprises the fewest profiles, and a finest one of the abrasive portions comprises the most profiles.

Item 42. The abrasive article of any of these items, further comprising an intermediate abrasive portion that is finer than the coarsest one, and coarser than the finest one, and the intermediate abrasive portion comprises a number of profiles that is less than that of the finest one.

Item 43. The abrasive article of any of these items, wherein a finest one of the at least one of the at least two abrasive portions comprises cerium oxide.

Item 44. The abrasive article of any of these items, wherein the recess comprises a slot, notch or groove, and extends along an entire axial length of the at least two abrasive portions.

Item 45. The abrasive article of any of these items, wherein the recess comprises a plurality of recesses, symmetrically spaced apart about the outer surface.

Item 46. The abrasive article of any of these items, wherein the porosity is formed by glass or ceramic beads.

Item 47. The abrasive article of any of these items, wherein each of the at least two abrasive portions has a profile formed therein, and the fluid passages in the at least two abrasive portions intersect the profiles, respectively.

Item 48. The abrasive article of any of these items, wherein a first one of the abrasive portions comprises a grit size of not greater than about 700 grit, not greater than about 600 grit, not greater than about 500 grit, not greater than about 400 grit.

Item 49. The abrasive article of any of these items, wherein a second one of the abrasive portions comprises a grit size of not greater than about 1100 grit, not greater than about 1000 grit, not greater than about 900 grit, not greater than about 800 grit, and at least about 500 grit, at least about 600 grit, at least about 700 grit.

Item 50. The abrasive article of any of these items, wherein a third one of the abrasive portions comprises a grit size of not greater than about 2000 grit, not greater than about 1500 grit, not greater than about 1400 grit, not greater than about 1200 grit, and at least about 900 grit, at least about 1000 grit, at least about 1100 grit.

Item 51. The abrasive article of any of these items, wherein the profile is formed in an exterior surface or perimeter of each abrasive portion, and circumscribes each abrasive portion.

Item 52. The abrasive article of any of these items, wherein the profile is formed by electrical discharge machining (EDM).

Item 53. The abrasive article of any of these items, wherein the profile can be re-profiled without damaging the abrasive article.

Item 54. The abrasive article of any of these items, wherein the profile is re-profiled by electrical discharge machining (EDM).

Item 55. The abrasive article of any of these items, wherein the profile has an axial dimension of not greater than about 1.5 mm, not greater than about 1.3 mm, not greater than about 1 mm, not greater than about 0.7 mm, not greater than about 0.5 mm, not greater than about 0.3 mm, and the axial dimension is at least about 0.1 mm, at least about 0.2 mm, or at least about 0.3 mm.

Item 56. The abrasive article of any of these items, wherein the profile comprises a flat profile, a flat and arris profile, or a bullnose profile.

Item 57. The abrasive article of any of these items, wherein the profile has a radial grind depth of at least about 0.1 mm, at least about 0.2 mm, at least about 0.3 mm, or at least about 0.4 mm, and not greater than about 0.9 mm, not greater than about 0.7 mm, or not greater than about 0.5 mm.

Item 58. The abrasive article of any of these items, wherein the profile in each abrasive portion is substantially identical.

Item 59. The abrasive article of any of these items, wherein the profiles are at a substantially same radial distance relative to the axis, but at different axial locations.

Item 60. The abrasive article of any of these items, wherein the profiles differ from each other by less than about 1%, less than about 0.5%, less than about 0.25%.

Item 61. The abrasive article of any of these items, wherein the profiles are axially spaced apart from each other in substantially identical increments.

Item 62. The abrasive article of any of these items, wherein the abrasive portions do not comprise a resin bond.

Item 63. The abrasive article of any of these items, wherein the abrasive portions comprise a metal bond.

Item 64. The abrasive article of any of these items, wherein the metal bond comprises copper and tin.

Item 65. The abrasive article of any of these items, wherein the abrasive portions comprise at least three abrasive portions.

Item 66. The abrasive article of any of these items, wherein each abrasive portion is configured to grind or polish glass.

Item 67. The abrasive article of any of these items, wherein the glass comprises a chemically-strengthened, ion exchange glass.

Item 68. The abrasive article of any of these items, wherein the abrasive portions are not electroplated on the shank.

Item 69. The abrasive article of any of these items, wherein the abrasive portions are mounted on the shank with an adhesive bond.

Item 70. The abrasive article of any of these items, wherein the abrasive portions comprise diamond grit.

Item 71. The abrasive article of any of these items, wherein each abrasive portion comprises a wheel having an axial bore, a diameter and an axial thickness.

Item 72. The abrasive article of any of these items, wherein the diameter of each wheel is not greater than about 25 mm, not greater than about 20 mm, not greater than about 15 mm, not greater than about 12 mm, or not greater than about 10 mm.

Item 73. The abrasive article of any of these items, wherein the shank is a single spindle having a proximal portion with a first diameter, a distal portion with a second diameter that is smaller than the first diameter, and a shoulder therebetween.

Item 74. The abrasive article of any of these items, wherein the abrasive portions are mounted on the distal portion, one of the abrasive portions abuts the shoulder, and another one of the abrasive portions abuts said one of the abrasive portions and is axially spaced apart from the shoulder.

Item 75. The abrasive article of any of these items, wherein a diameter of the shank is at least about 1 mm, at least about 2 mm, at least about 3 mm, at least about 4 mm, at least about 5 mm, and not greater than about 10 mm, not greater than about 8 mm, not greater than about 6 mm.

Item 76. The abrasive article of any of these items, wherein each of the abrasive portions is mounted directly to and in contact with the shank, or to a hub that is directly mounted to the shank, such that the hub is located between the abrasive portions and the shank.

Item 77. The abrasive article of any of these items, wherein the abrasive portions are mounted directly to and in axial abutment with each other.

Item 78. The abrasive article of any of these items, wherein the abrasive portions have an outer surface that is substantially cylindrical.

Item 79. The abrasive article of any of these items, wherein the abrasive portions have an outer surface that is conical.

Item 80. The abrasive article of any of these items, wherein the abrasive portions are stepped such that outer surfaces thereof have different maximum radial dimensions.

Item 81. The abrasive article of any of these items, wherein each abrasive portion comprises a plurality of steps, each step has the profile, and each step has a different maximum radial dimension within each abrasive portion.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An abrasive article, comprising:

a shank having an axis;

a first and a second abrasive portion coupled to the shank in an axial array with respect to each other;

a first profile formed in the first abrasive portion;

a second profile formed in the second abrasive portion; and a third profile formed in the first or second abrasive portion, wherein the first, second and third profiles are substantially identical to each other.

2. The abrasive article of claim 1, further comprising a recess extending axially along at least a portion of an outer surface of the first and second abrasive portions.

3. The abrasive article of claim 1, further comprising one or more fluid passages including an interconnected passage through a portion of the shank and at least one of the first and second abrasive portions.

4. The abrasive article of claim 1, wherein the first and second abrasive portions are stepped such that outer surfaces thereof have different maximum radial dimensions.

5. The abrasive article of claim 1, wherein at least one of the first and second abrasive portions is mounted directly to and in contact with the shank.

6. The abrasive article of claim 1, wherein at least one of the first and second abrasive portions comprises a grit size of not greater than about 700 grit.

7. The abrasive article of claim 1, further comprising a third abrasive portion coupled to the shank in an axial array with respect to the first and second abrasive portions.

8. The abrasive article of claim 7, wherein the third abrasive portion comprises a grit size of not greater than about 2000 grit, and at least about 900 grit.

9. The abrasive article of claim 1, wherein the profiles are at a substantially same radial distance relative to the axis, but at different axial locations.

10. The abrasive article of claim 1, wherein the abrasive portions comprise a metal bond.

11. The abrasive article of claim 1, wherein the abrasive portions are mounted on the shank by an adhesive bond, a fastener, or a combination thereof.

12. The abrasive article of claim 1, wherein the abrasive portions are mounted directly to and in axial abutment with each other.

13. The abrasive article of claim 1, wherein at least one of the abrasive portions comprises cerium oxide.

14. The abrasive article of claim 1, wherein at least one of the abrasive portions has an outer surface and a recess extending axially along at least a portion of the outer surface.

15. The abrasive article of claim 1, wherein the shank comprises carbon fiber.

16. The abrasive article of claim 3, further comprising at least two fluid passages including an interconnected passage through a portion of the shank and at least two abrasive portions, wherein the fluid passages in the two abrasive portions intersect the profiles, respectively.

17. The abrasive article of claim 1, wherein a coarsest one of the abrasive portions comprises a fewest number of profiles, and a finest one of the abrasive portions comprises a largest number of profiles.

18. The abrasive article of claim 1, wherein the abrasive portions have outer surfaces that are conical.

19. The abrasive article of claim 1, wherein at least one of the abrasive portions comprises at least two distinct profiles formed therein.

20. The abrasive article of claim 7, wherein at least one of the abrasive portions comprises at least two distinct profiles formed therein.

* * * * *